US005915554A

United States Patent [19]

Hung

[11] Patent Number: 5,915,554

[45] Date of Patent: Jun. 29, 1999

[54] TOOL BOX ASSEMBLY WITH A SWIVEL TOOL RACK

[76] Inventor: Chiu-Ho Hung, No. 105-2, Taitien, 7 Lin, Taitien Li, Yuanli Chen, Miaoli Hsien, Taiwan

[21] Appl. No.: 09/112,980

[22] Filed: Jul. 9, 1998

[51] Int. Cl.[6] ..... B65D 85/00

[52] U.S. Cl. ..... 206/372; 206/373

[58] Field of Search ..... 206/234, 372, 206/373, 349, 775, 776, 777, 485, 315.11

[56] References Cited

U.S. PATENT DOCUMENTS 5,676,254 10/1997 Cheng et al. ..... 206/373 X 5,803,254 9/1998 Vasudeva ..... 206/373

*Primary Examiner*—Jacob K. Ackun

*Attorney, Agent, or Firm*—William E. Pelton, Esq.

[57] ABSTRACT

A tool box assembly includes a case, a hollow cover pivotally mounted on the case, a rectangular frame extending inward from an inner periphery of the hollow cover and having two opposite longer sides each transversely containing an elongated guiding groove, and a rectangular swivel tool rack pivotally mounted in the rectangular frame and having two opposite longer sides each formed with a pivot stub slidably received in the guiding groove of one of the two opposite longer sides of the hollow cover.

8 Claims, 6 Drawing Sheets

TOOL BOX ASSEMBLY WITH A SWIVEL TOOL RACK

FIELD OF THE INVENTION

The present invention relates to a tool box assembly, and more particularly to a tool box assembly with a swivel tool rack.

BACKGROUND OF THE INVENTION

A conventional tool box comprises a case for receiving a plurality of tools therein, a cover pivotally connected with the case for closing the case, and a snapping member mounted between the case and the cover for fastening the cover with the case. By such an arrangement, however, a user has to open the snapping member so as to detach the cover from the case such that the user can take the tools received in the case. When the intent is to take a single tool only, the user still has to open the snapping member to detach the cover from the case so as to take the single tool from the case, thereby easily causing an inconvenience in use. The present invention has arisen to mitigate and/or obviate the disadvantage of the conventional tool box.

SUMMARY OF THE INVENTION

In accordance with one aspect of the present invention, there is provided a tool box assembly comprising a case, a hollow cover pivotally mounted on the case, a rectangular frame extending inward from an inner periphery of the hollow cover and including two opposite longer sides each transversely containing an elongated guiding groove and two opposite shorter sides, and a rectangular swivel tool rack pivotally mounted in the rectangular frame and including two opposite longer sides each formed with a pivot stub slidably received in the guiding groove of one of the two opposite longer sides of the hollow cover and two opposite shorter sides.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
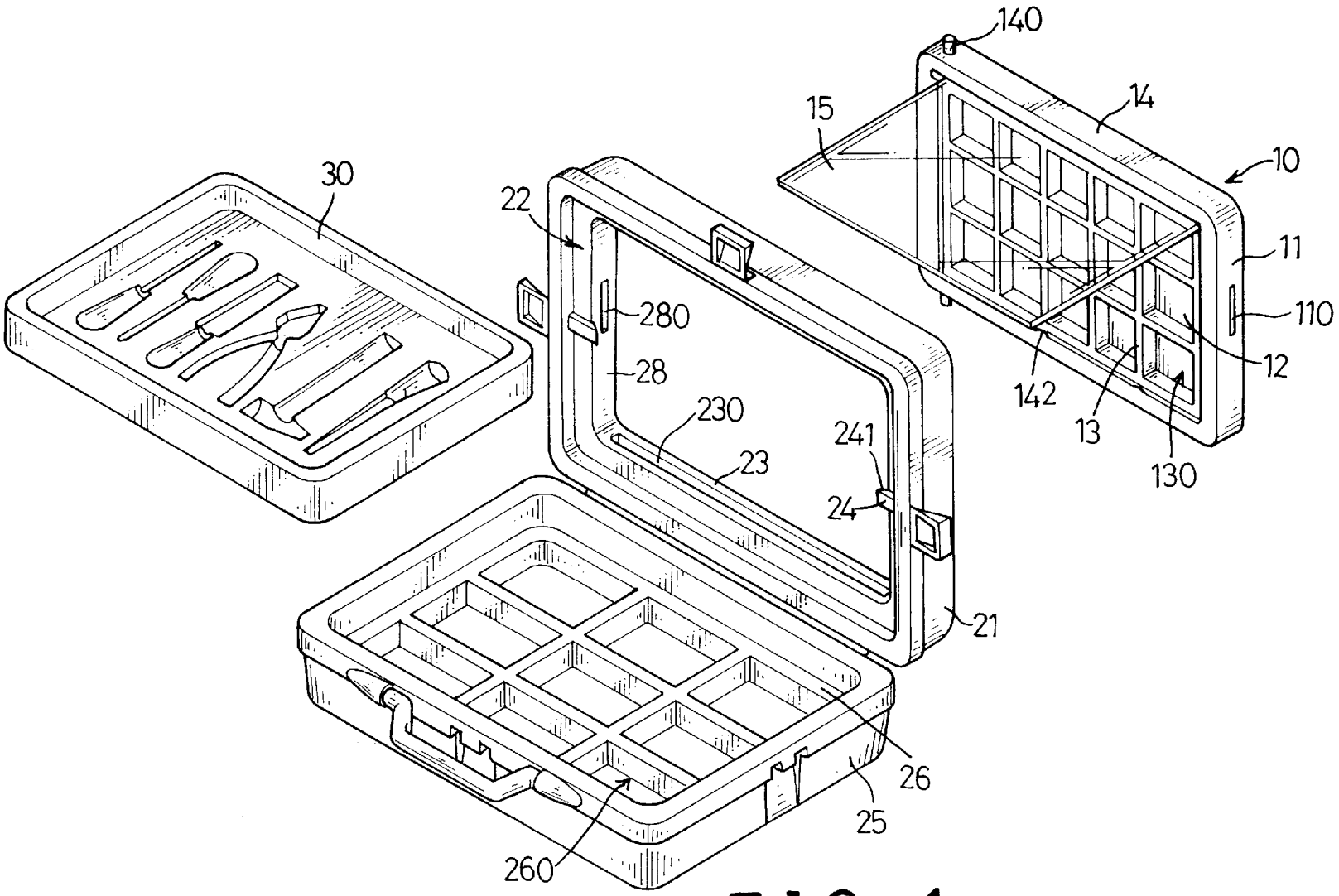
FIG. 1 is an exploded view of a tool box assembly in accordance with the present invention.

Referring to the drawings and initially to FIGS. 1–5, a tool box assembly in accordance with the present invention comprises a case 25, a hollow cover 21 pivotally mounted on the case 25, a rectangular frame 22 extending inward from an inner periphery of the hollow cover 21 and including two opposite longer sides 23 each transversely containing an elongated guiding groove 230 and two opposite shorter sides 28, and a rectangular swivel tool rack 10 pivotally mounted in the rectangular frame 22 and including two opposite longer sides 14 each formed with a pivot stub 140 slidably received in the guiding groove 230 of one of the two opposite longer sides 23 of the hollow cover 21 and two opposite shorter sides 11.

The case 25 includes a bottom portion formed with a supporting bracket 26 containing a plurality of receiving spaces 260 for receiving tools (not shown) therein. An auxiliary tool rack 30 is detachably received in the case 25 and is supported on the supporting brackets 26.

Each of the two opposite shorter sides 28 of the rectangular frame 22 is formed with a catch 24 extending inward to retain each of the two opposite shorter sides 11 of the rectangular swivel tool rack 10. The catch 24 of each of the two opposite shorter sides 28 of the rectangular frame 22 is formed with a beveled surface 241 facing one of the two opposite shorter sides 11 of the rectangular swivel tool rack 10.

Each of the two opposite shorter sides 28 of the rectangular frame 22 transversely contains an elongated semi-circular receiving cavity 280, and each of the two opposite shorter sides 11 of the rectangular swivel tool rack 10 is formed with an elongated semi-circular bar 110 detachably snapped into the elongated cavity 280 of each of the two opposite shorter sides 28 of the rectangular frame 22.

The swivel tool rack 10 includes a closed first end face 12 and an open second end face 13 containing a plurality of receiving openings 130 for receiving tools (not shown) therein. A transparent lid 15 is pivotally mounted on the open second end face 13 of the swivel tool rack 10 and includes one side pivotally connected to one of the two longer sides 14 of the swivel tool rack 10 which is formed with a plurality of bosses 142 on the other longer side 14 thereof for retaining the other edge of the transparent lid 15.

Figure 2:
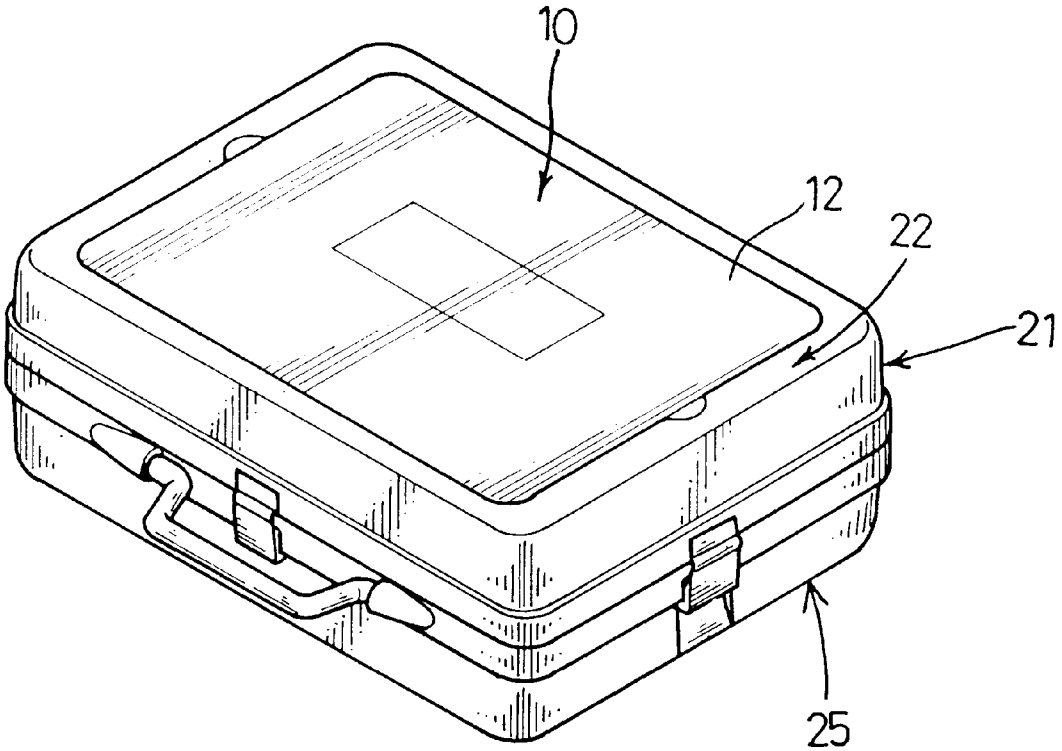
FIG. 2 is a perspective assembly view of the tool box assembly as shown in FIG. 1.
Figure 3:
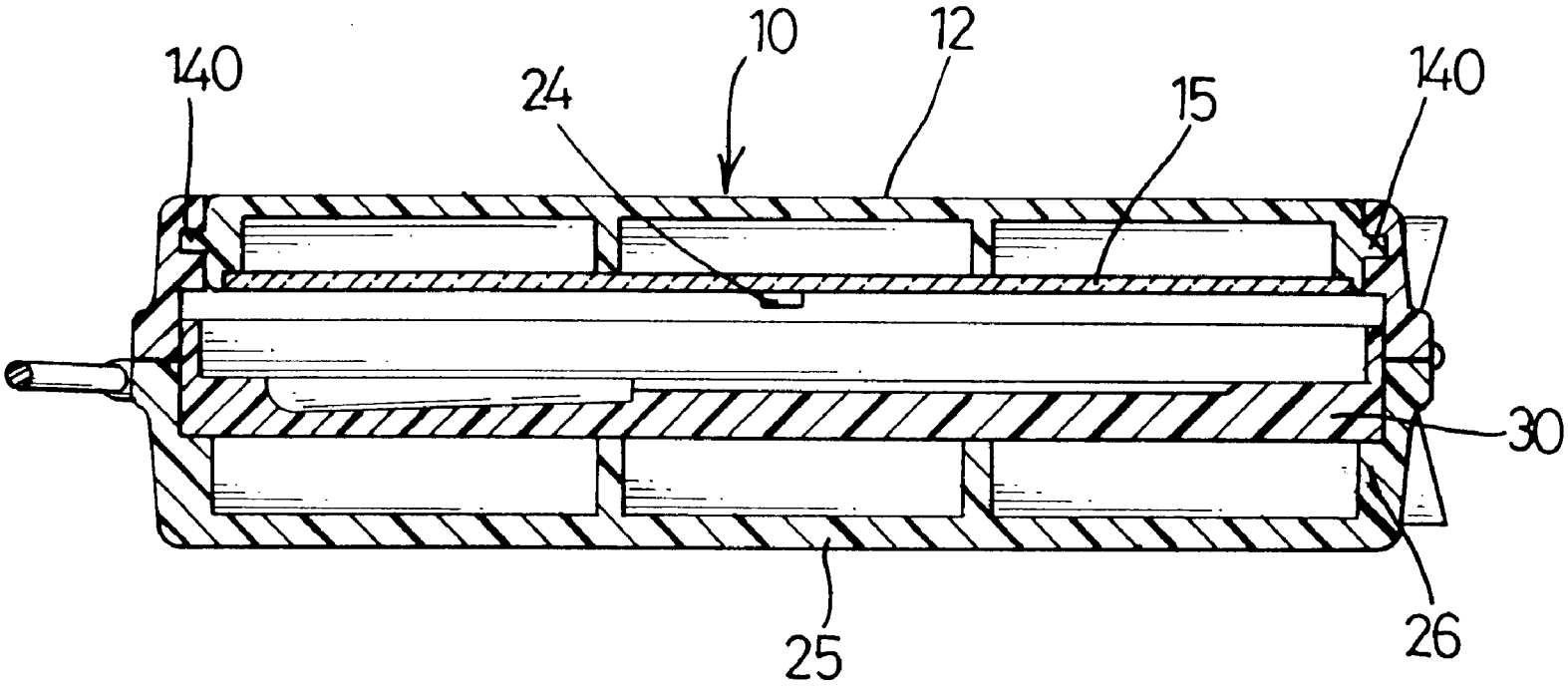
FIG. 3 is a side plan cross-sectional view of the tool box assembly as shown in FIG. 2.
Figure 4:
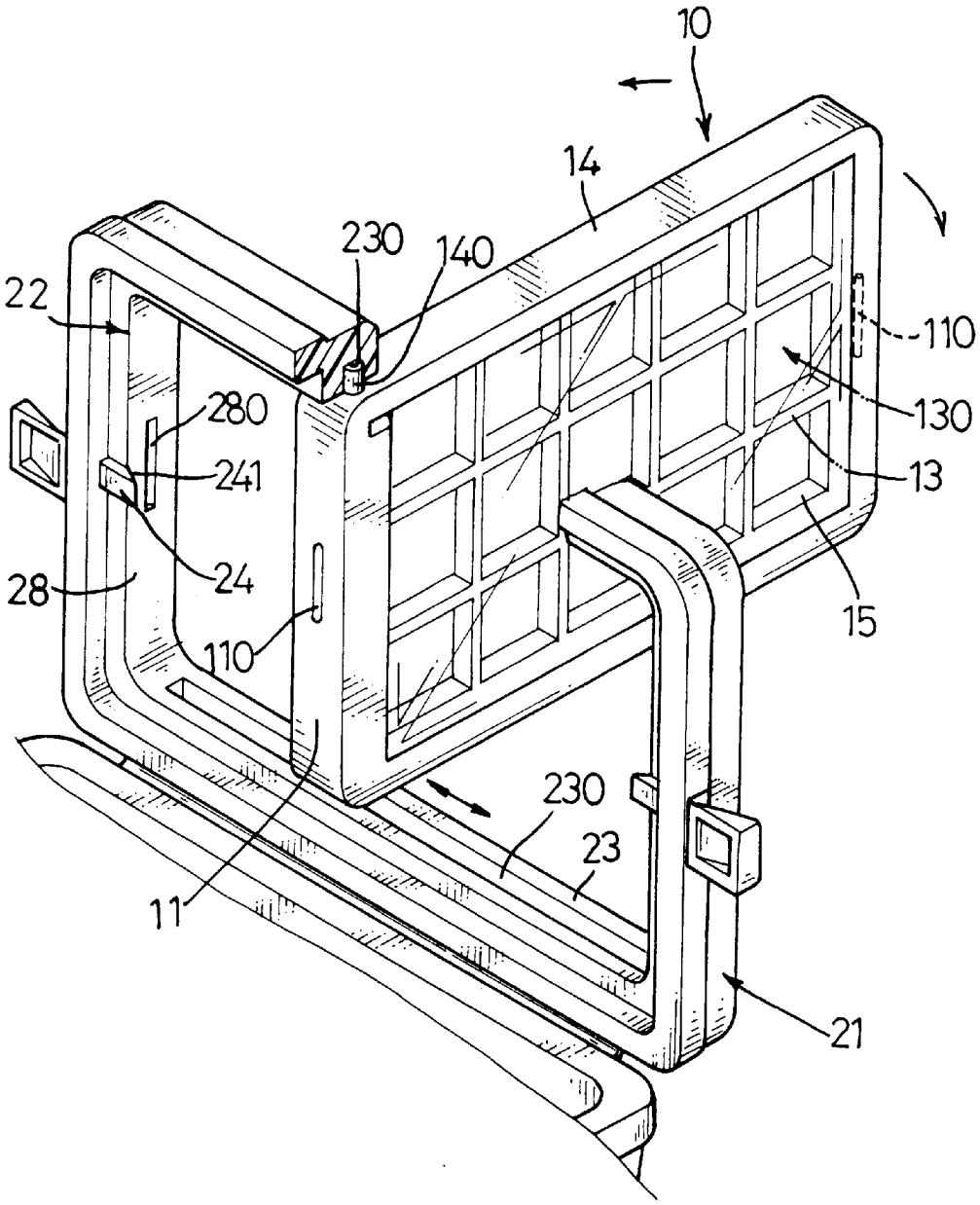
FIG. 4 is a partially cut-away operational view of the tool box assembly as shown in FIG. 1.
Figure 5:
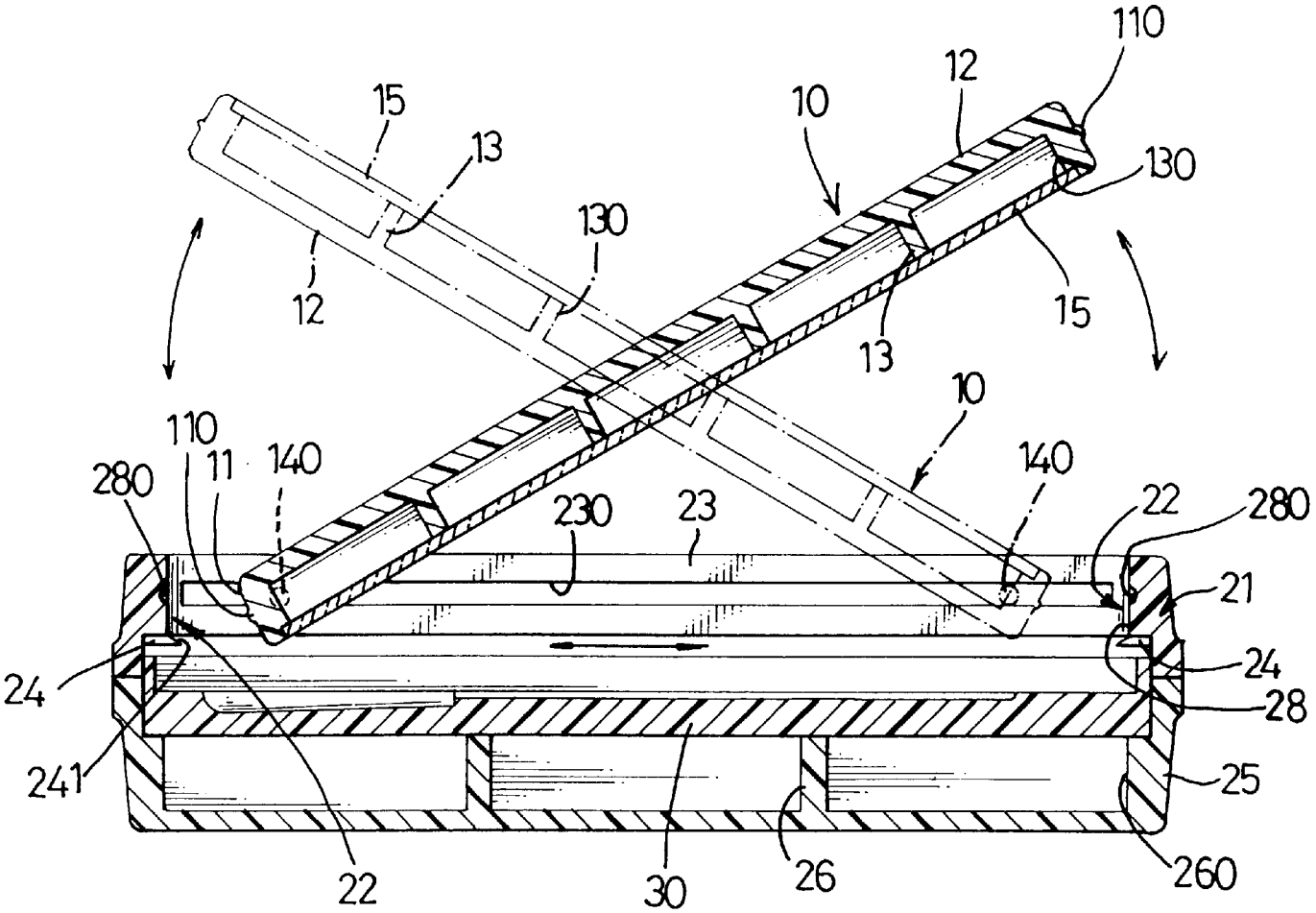
FIG. 5 is a front plan cross-sectional operational view of the tool box assembly as shown in FIG. 2.
Figure 6:
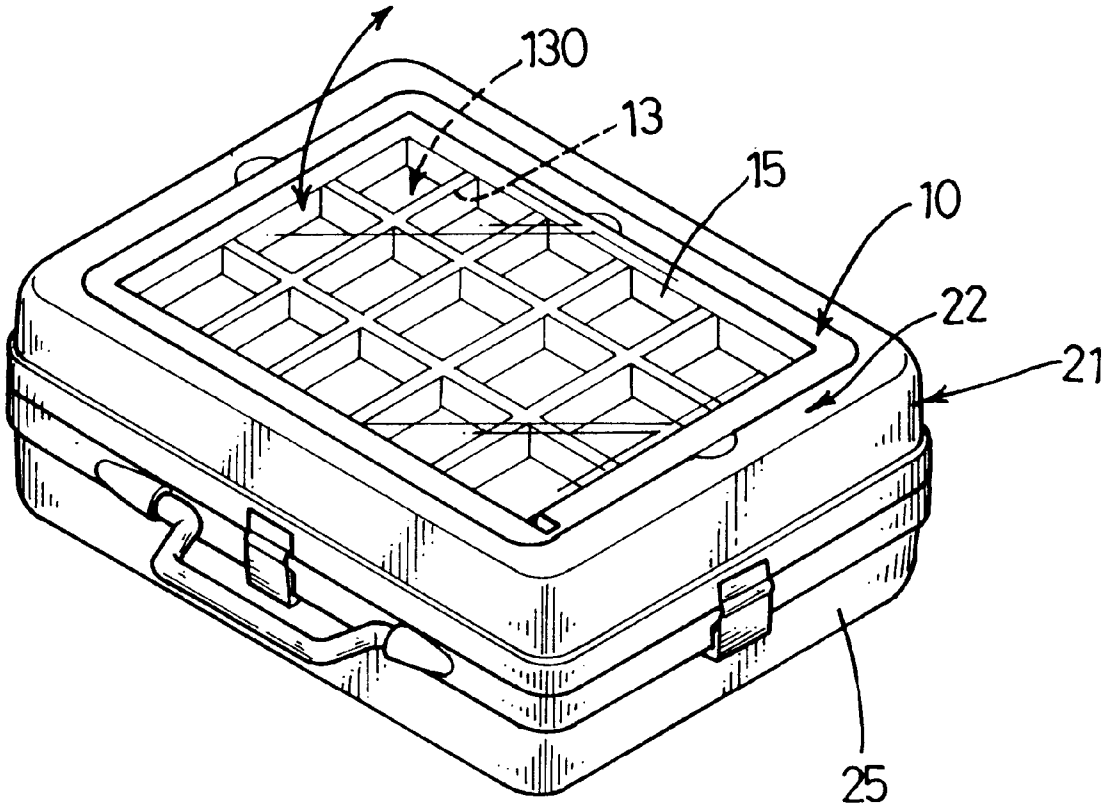
FIG. 6 is a perspective assembly view of the tool box assembly as shown in FIG. 1 in accordance with another embodiment of the present invention.

In operation, referring now to FIGS. 4–6 with reference to FIGS. 1–3, the swivel tool rack 10 is initially received in the rectangular frame 22 of the hollow cover 21 with the closed first side 12 thereof exposed to surroundings as shown in FIG. 2. The swivel tool rack 10 can then be pivoted outward relative to the hollow cover 21 with the pivot stub 140 of each of the two longer sides 14 thereof being slidable along the guiding groove 230 as shown in FIG. 4.

Especially referring to FIG. 5, the pivot stub 140 of each of the two longer sides 14 of the swivel tool rack 10 can then slide along the guiding groove 230 from a first position as shown in solid lines to a second position as shown in phantom lines where the swivel tool rack 10 can be pivoted inward relative to the hollow cover 21 about the pivot stub 140 to a position as shown in phantom lines.

The swivel tool rack 10 can then be further pivoted relative to the hollow cover 21 to be received into the rectangular frame 22 with the open second side 13 thereof together with the transparent lid 15 being exposed to surroundings as shown in FIG. 6 such that a user can see the tools received in the receiving openings 130 of the open second side 13 of the swivel tool rack 10 via the transparent lid 14.

By such an arrangement, the swivel tool rack 10 can be pivoted relative to the hollow cover 21 so as to expose the transparent lid 15 to surroundings as shown in FIG. 6 such that the transparent lid 15 can be directly opened by the user to take the tools from the tool rack 10 without having to open the hollow cover 21 from the case 25, thereby greatly facilitating the removal of tools for use. In addition, the swivel tool rack 10 can also be pivoted relative to the hollow cover 21 so as to expose the closed first side 12 thereof to surroundings as shown in FIG. 2 such that the transparent lid 15 can be hidden in the swivel tool rack 10, thereby preventing the transparent lid 15 from being scraped or worn out. Further, the swivel tool rack 10 can also be detached from the hollow cover 21 as shown in FIG. 1 to be used by the user separately.

It should be clear to those skilled in the art that further embodiments may be made without departing from the scope and spirit of the present invention.

What is claimed is:

1. A tool box assembly comprising:

a case (25);

a hollow cover (21) pivotally mounted on said case (25), a rectangular frame (22) extending inward from an inner periphery of said hollow cover (21) and including two opposite longer sides (23) each transversely containing an elongated guiding groove (230) and two opposite shorter sides (28); and a rectangular swivel tool rack (10) pivotally mounted in said rectangular frame (22) and including two opposite longer sides (14) each formed with a pivot stub (140) slidably received in said guiding groove (230) of one of said two opposite longer sides (23) of said hollow cover (21) and two opposite shorter sides (11).

2. The tool box assembly in accordance with claim 1, wherein said case (25) includes a bottom portion formed with a supporting bracket (26) containing a plurality of receiving spaces (260) therein.

3. The tool box assembly in accordance with claim 2, further comprising an auxiliary tool rack (30) detachably received in said case (25) and supported on said supporting bracket (26).

4. The tool box assembly in accordance with claim 1, wherein each of said two opposite shorter sides (28) of said rectangular frame (22) is formed with a catch (24) extending inward for retaining each of said two opposite shorter sides (11) of said rectangular swivel tool rack (10).

5. The tool box assembly in accordance with claim 4, wherein said catch (24) of each of said two opposite shorter sides (28) of said rectangular frame (22) is formed with a beveled surface (241) facing one of said two opposite shorter sides (11) of said rectangular swivel tool rack (10).

6. The tool box assembly in accordance with claim 1, wherein each of said two opposite shorter sides (28) of said rectangular frame (22) transversely contains an elongated semi-circular receiving cavity (280), and each of said two opposite shorter sides (11) of said rectangular swivel tool rack (10) is formed with an elongated semi-circular bar (110) detachably snapped into said elongated cavity (280) of each of said two opposite shorter sides (28) of said rectangular frame (22).

7. The tool box assembly in accordance with claim 1, wherein said swivel tool rack (10) includes a closed first end face (12) and an open second end face (13) containing a plurality of receiving openings (130) therein.

8. The tool box assembly in accordance with claim 7, further comprising a transparent lid (15) pivotally mounted on said open second end face (13) of said swivel tool rack (10).

* * * * *